US007036899B2

(12) United States Patent
Sato et al.

(10) Patent No.: US 7,036,899 B2
(45) Date of Patent: May 2, 2006

(54) PRINTING APPARATUS AND PRINTHEAD CONTROL METHOD

(75) Inventors: Takashi Sato, Tokyo (JP); Joji Nagahira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 265 days.

(21) Appl. No.: 10/715,691

(22) Filed: Nov. 19, 2003

(65) Prior Publication Data

US 2004/0201636 A1 Oct. 14, 2004

(30) Foreign Application Priority Data

Nov. 25, 2002 (JP) ..... 2002-341258

(51) Int. Cl.
*B41J 29/38* (2006.01)

(52) U.S. Cl. ..... 347/10; 347/9; 347/14; 358/1.1

(58) Field of Classification Search ..... None
See application file for complete search history.

(56) References Cited

U.S. PATENT DOCUMENTS

| | | | | |
|---|---|---|---|---|
| 6,068,360 | A * | 5/2000 | Hiwada | 347/14 |
| 6,382,755 | B1 * | 5/2002 | Imanaka et al. | 347/12 |
| 6,652,057 | B1 * | 11/2003 | Masuda et al. | 347/14 |
| 2003/0142156 | A1 | 7/2003 | Sato | 347/9 |

FOREIGN PATENT DOCUMENTS

JP 6-233530 8/1994

* cited by examiner

*Primary Examiner*—Thinh Nguyen
*Assistant Examiner*—Brian J. Goldberg
(74) *Attorney, Agent, or Firm*—Fitzpatrick, Cella, Harper & Scinto

(57) ABSTRACT

In a printing apparatus in which printing is performed by a printhead having a plurality of printing elements, each driven by electrical energy, and the number of printing elements driven at the same time is changed depending upon the print data, the timing at which the number of printing elements driven simultaneously increases by a large amount is detected by using M bits of drive data transferred first in serially transferred N bits of drive data, and the electrical energy supplied to the printhead is increased before this timing.

3 Claims, 9 Drawing Sheets

PRINTING APPARATUS AND PRINTHEAD CONTROL METHOD

FIELD OF THE INVENTION

This invention relates to a printing apparatus and a printhead control method and, more particularly, to control of a printhead in a printing apparatus in which printing is performed by a printhead having a plurality of printing elements each driven by electrical energy, wherein the number of printing elements driven at the same time is changed depending upon the print data.

BACKGROUND OF THE INVENTION

A printing apparatus is employed widely as the information output means of printers, copiers and facsimile machines. A thermal printer is one example of such a printing apparatus. Another example is an ink-jet printing apparatus that prints characters and images by discharging ink on a printing medium such as printing paper.

An ink-jet printing apparatus prints by discharging ink while a printhead that discharges the ink is made to move relative to the printing medium. Control of the relative speed between the ink-jet printhead and the printing medium, control of the timing of ink discharge that accompanies this movement, and the stability with which the printhead is supplied with power are factors that influence the image quality of the printed result.

An ink-jet printing apparatus may be classified broadly into two types, namely so-called serial type and full-line type, depending upon the mode of the ink-jet printhead. The serial-type apparatus of these performs printing by discharging ink while the ink-jet printhead is moved (scanned) relative to the printing medium. The serial-type apparatus is in wide use because of the simplicity of its structure.

Types of printhead that discharge ink include one that discharges the ink by the operation of piezoelectric elements and one that discharges the ink by causing the ink to undergo film boiling momentarily. A printhead of the type that discharges ink by the film boiling of ink is so adapted that by passing a current into a heater provided in the vicinity of ink passageway near an ink orifice, ink in the vicinity of the heater is cause to undergo film boiling to thereby provide the discharge energy.

Uniform ink droplets are obtained by arranging it so that the energy for discharging the ink is supplied stably at all times and so that the ink discharge will take place under the same conditions. This is important in terms of maintaining an excellent print image quality. However, since the frequency (duty ratio) with which ink is discharged differs depending upon the print data in the printing operation, the number of heaters energized simultaneously differs from time to time. As a consequence, a change occurs in the driving conditions, in accordance with the image data to be printed, owing to such effects as a fluctuation in voltage caused by a difference in the value of current that is output from a power supply, and a difference in a voltage drop ascribable to the resistance component of the transmission system.

In order to stabilize such driving conditions, it has been contrived heretofore to raise the precision of the output voltage from the power source or to adopt an arrangement that minimizes loss in the transmission system.

A DC/DC converter that supplies power to the header of a printhead will be described next.

In order to cause film boiling in ink momentarily by passing a current into the heater, as mentioned above, it is required that the heater be supplied with a high voltage. To achieve this, a DC/DC converter is used for the purpose of generating a voltage higher than the power-supply voltage of the other circuitry.

FIG. 7 is a circuit diagram illustrating an example of the structure of the conventional DC/DC converter and its voltage control circuit. The input voltage Vin of the DC/DC converter supplied from a power supply unit (not shown) is applied to a switching element 201. A DC output obtained by a conversion in the switching element 201 and diode 209 is delivered via an inductance 202 and is supplied as an output voltage VH-b to a printhead serving as a load.

A capacitor 203 is connected to the input side of the switching element 201. Further, a capacitor 204 is connected via the inductance 202 and a smoothing circuit 205 is constructed by the inductance 202 and capacitor 204. The output voltage signal VH-b, which is detected from the output terminal of the smoothing circuit 205, is input to a current control circuit 206 upon being voltage-divided by resistors R1 and R2, and feedback of the signal is controlled by an error amplifier 207 constituting the voltage control circuit 206.

A potential obtained by voltage-dividing a reference voltage Vref by resistors R3, R4 and a potential obtained by voltage-dividing the feed-back output voltage VH-b by the resistors R1, R2 are input to the error amplifier 207. The output signal of the error amplifier 207, which is the output signal of the voltage control circuit 206, controls the switching element 201 to a constant voltage via a PWM comparator 208. A resistor R5 and a capacitor C1 connected between an inverting terminal and the output terminal of the error amplifier 207 represent one example of a phase compensating circuit.

Thus, the output of the DC/DC converter is subjected to feedback control so as to supply a stable output voltage irrespective of the value of output current, which varies owing to a change in the number of nozzles driven simultaneously by the printhead constituting the load.

It has become possible in recent years to handle color images with facility owing to the higher speeds of computers and the like. In addition, as a result of the greater number of pixels usable in image input devices such as digital cameras, there is much greater demand for higher image quality and higher speed in ink-jet printers used as the output devices. By way of example, an increase in the speed of the printing operation of an ink-jet printer can be achieved by raising the discharge (driving) frequency and by increasing the number of nozzles that are driven simultaneously. It is possible to achieve both an improvement in image quality and higher speed by discharging the ink from each nozzle as extremely small liquid droplets and increasing the amount of ink discharged per unit time.

Consider a case where printing speed is raised by increasing the number of nozzles driven simultaneously. Among the nozzles arranged so as to be capable of being driven simultaneously, of course the number of nozzles actually driven to discharge ink changes depending upon the image recorded at the time. When an all-black image is printed, for example, it is necessary to discharge ink simultaneously from all of the nozzles that are capable of discharging ink. On the other hand, if the image is one having a low duty ratio, such as a ruled line, only some of the nozzles need discharge ink simultaneously.

As mentioned above, the printing operation, i.e., ink discharge, of an ink-jet printhead in a serial printer is achieved by thermal energy produced by passing a current into heaters.

Since electric current is necessary for the ink discharge, the value of current required increases in proportion to the increase in number of nozzles that discharge ink simultaneously. Further, with a serial printer, the number of nozzles that are driven simultaneously is not always fixed and the number varies successively in accordance with the print data sent to the printhead.

In other words, in an ink-jet printer that forms images, designs, patterns and characters, etc., on a printing medium in accordance with image data transmitted from an external device, the amount of ink discharged from the printhead per unit time is decided by the image data sent from the external device, and the power consumed by the printhead per unit time is decided by the amount of ink discharged per unit time.

That is, the greater the amount of image data, the greater the number of nozzles driven simultaneously and the greater the power consumed by the printhead. Conversely, if the amount of image data per unit time is small, the number of nozzles driven simultaneously is small and the power consumed by the printhead is small. Thus, the amount of current that the DC/DC converter supplies to the printhead is decided in proportion to the number of nozzles driven simultaneously.

With regard to an improvement in the characteristic of voltage control in a DC/DC converter, the specification of Japanese Patent Application Laid-Open No. 6-233530 discloses a method of inserting a resistor in the output line, detecting load current and improving response when there is a sudden change in load. However, because a voltage drop is produced by the resistor inserted into the output line, it is difficult to apply this method to a DC/DC converter that supplies power to the ink-jet printhead, which requires a voltage of high precision. Furthermore, since a loss in power due to the inserted resistor also occurs, the power conversion efficiency deteriorates. Accordingly, this method is not desirable in a small-size DC/DC converter.

The power supply that supplies the printhead with power will now be described. In order to diminish a fluctuation in output power with respect to a change in current caused by a change in the number of nozzles driven simultaneously in the printhead constituting the load, the value of a steady gain K in the voltage feedback control loop is enlarged.

When the value of the steady gain K is increased, however, not only is stability lost in the unloaded state but there is also the danger that problems will arise owing to nonlinearity of the PWM control loop.

The value of the steady gain K cannot be made very large for the foregoing reasons. The conventional voltage control loop, therefore, cannot deal adequately with a momentary current fluctuation ascribable to a fluctuation in load and the transient fluctuation characteristic of output voltage deteriorates. The drop in output voltage with respect to a momentary current fluctuation is suppressed by a capacitative component typified by an electrolytic capacitor, which converts the momentary current to an average current, inserted into the output end of the circuit.

The power supply of an ink-jet printer in which the driving conditions of the printhead that discharges ink droplets change greatly depending upon the image data transmitted from an external device must be designed so as to supply an output voltage stably with respect to all momentary load fluctuations taking into account also the driving conditions of the printhead. However, since the value of the gain K cannot be made sufficiently large, a constant-voltage control circuit cannot follow up a momentary current fluctuation that occurs suddenly from the unloaded state up to a rated maximum current value at which drive, which is the fully loaded state, is achieved. As a result, the power supply is designed so as to suppress the output voltage fluctuation by enlarging the capacitance of the capacitative component typified by an aluminum electrolytic capacitor or the like inserted into the output end of the power supply means.

As mentioned above, in a case where load fluctuates sharply from the unloaded state, in which there is no ink discharge, to the maximum load current for discharging ink from all nozzles of the printhead, the above-described voltage control circuit that relies upon error amplification using the potential difference between a reference voltage and the output voltage is such that the voltage control circuit can no longer follow up owing to a delay in the constant-voltage feedback (the amount of error voltage in the error amplifier) of the DC/DC converter, and hence voltage drops below the set voltage. It is necessary to make the capacity of the output capacitor fairly large in order to prevent this drop in output voltage. However, this is an impediment as far as a reduction in the size and thickness of the DC/DC converter is concerned.

Furthermore, in order to achieve higher speed and better image quality, there is a tendency for the printhead of the ink-jet printer to be made longer and to be provided with a greater number of nozzles so that the number of nozzles driven simultaneously increases. This means that the maximum output current of the load takes on a large value. A method other than the method of enlarging the capacity of a capacitor is needed to suppress the drop in output voltage at the time of a sudden change in load.

SUMMARY OF THE INVENTION

Accordingly, an object of the present invention is to suppress a fluctuation in voltage, which is applied to each printing element, without enlarging the capacity of an output capacitor even when there is a sudden change in the driven load of a printhead.

According to one aspect of the present invention, the foregoing object is attained by providing a printing apparatus for performing printing using a printhead having a plurality of printing elements, comprising: means for inputting print data; converting means for converting print data to drive data corresponding to the printing elements; transfer means for transferring the drive data to the printhead in a serial format in unit of N bits at a time; driving means for driving the printing elements based upon the drive data; counting means for counting M-bits of data transferred first among the drive data in synchronism with transfer of the drive data by the transfer means, where N>M; detecting means for detecting an increase in the value of a count obtained by the counting means; and voltage generating means for outputting a voltage that drives the printing elements; wherein if the detecting means has detected an increase in the value of the count, the voltage generating means raises the output voltage before the driving means performs drive based upon drive data transferred next.

That is, in a printing apparatus in which printing is performed by a printhead having a plurality of printing elements each driven by electrical energy, wherein the number of printing elements driven at the same time is changed depending upon the print data, the timing at which the number of printing elements driven simultaneously increases by a large amount is detected based upon the print data, and the electrical energy supplied to the printhead is increased before this timing.

If this arrangement is adopted, the electrical energy supplied to the printhead will increase in advance even if there is a large increase in the number of printing elements driven simultaneously. As a result, it is possible to prevent the power supply capability from failing to follow up a sudden change in load and the voltage impressed upon printing elements can be prevented from dropping.

Accordingly, a fluctuation in voltage applied to each printing element can be prevented from fluctuating without enlarging the capacity of the output capacitor even when the driven load of the printhead changes suddenly.

The voltage generating means may have an error amplifier for outputting a control signal in accordance with an error between a reference voltage and an input voltage, and if the detecting means has detected an increase in the value of the count, the value of the reference voltage is changed. In this case, the voltage generating means may differentiate a signal that is output in accordance with detection by the detection means and adds a voltage, which has been obtained via a time-constant circuit and a current adding circuit, to the reference voltage.

In a case where the value of the count is classified into at least three stages and the value of the count changes by more than a prescribed stage, the detecting means may detect an increase in the counted value.

The printhead may be a printhead that performs printing by discharging ink. More preferably, the printhead has an electrothermal converter for generating thermal energy applied to the ink.

According to another aspect of the present invention, the foregoing object is attained by providing a method of controlling a printing apparatus for performing printing by a printhead having a plurality of printing elements each driven by electrical energy, the number of printing elements driven simultaneously being changed in accordance with drive data, the method comprising: a transfer step of transferring drive data to the printhead in a serial format in units of N bits at a time; a counting step of counting M-bits of data transferred first among the transferred drive data, where N>M; a determination step of determining whether the number of simultaneously driven printing elements has increased greatly, based upon a count value regarding print data that has been transferred previously and a count value regarding drive data to be transferred later; and an energy increasing step of increasing electrical energy, which is supplied to the printhead, before the printhead is driven by drive data to be transferred later, if it has been determined that the number of simultaneously driven printing elements has increased greatly.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the following embodiments, a printer will be described as an example of a printing apparatus for utilizing an inkjet printing system.

In this specification, "print" means not only to form significant information such as characters and graphics, but also to form, e.g., images, figures, and patterns, on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

<Mechanical Structure of Printing Apparatus>

Figure 8:
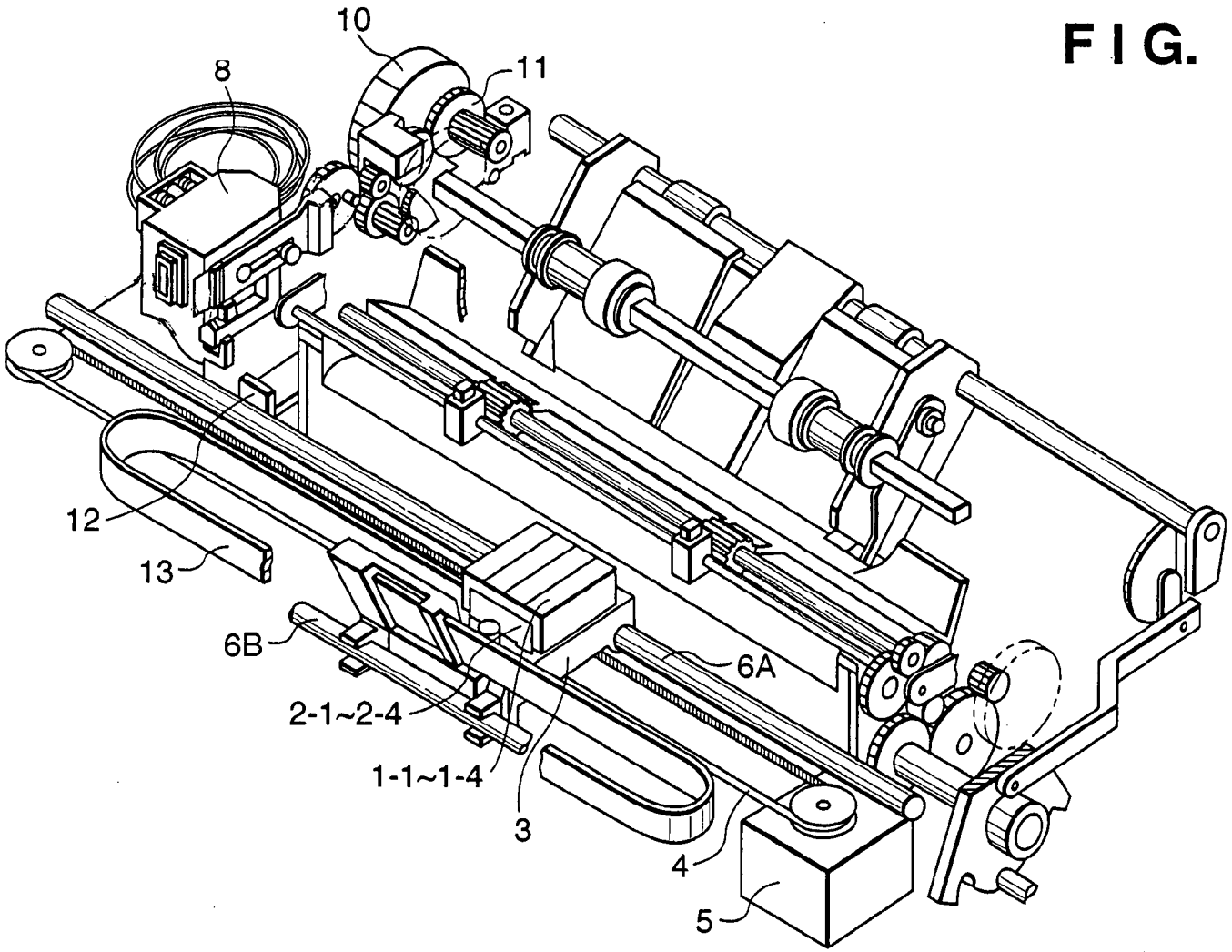
FIG. 8 is a perspective view illustrating the mechanism of an ink-jet printing apparatus according to the present invention.

FIG. 8 is a perspective view illustrating the mechanism of an ink-jet printing apparatus according to the present invention.

As shown in FIG. 8, four ink-jet printheads for printing respective ones of colors, namely a Bk (black) head 2-1, a Y (yellow) head 2-2, an M (magenta) head 2-3 and a C (cyan) head 2-4, ink tanks 1-1 to 1-4 attached integrally to the printheads and an optical home position sensor (referred to as an "HP sensor" below) 8 are mounted on a carriage 3. The carriage 3 is coupled to part of a drive belt 4 that transmits the driving power of a carriage drive motor 5 and is movably mounted on guide shafts 6A and 6B disposed in parallel with the scanning direction. The arrangement is such that the carriage 3 is moved back and forth by the driving force of the carriage drive motor 5 relative to a platen, which is disposed so as to face the ink discharge surface of the ink-jet printheads 2-1 to 2-4, to thereby print across the full width of printing paper transported by a printing-medium transport mechanism (not shown).

The ink-jet printheads 2-1 to 2-4 are provided with rows of slender pipe-shaped nozzles serving as a plurality of orifices for discharging ink. Provided in close proximity to the nozzles are heaters for applying discharge energy to the inks supplied from the integrated ink tanks 1-1 to 1-4.

The nozzles of the printheads 2-1 to 2-4 are arrayed in a direction perpendicular to the scanning direction of the carriage 3. The four printheads themselves are arranged side by side along the scanning direction of the carriage 3.

The HP sensor 8 is used to decide a reference position (the carriage home position) along the scanning direction of the printing operation by detecting a protuberance 12, which is for reference-position detection, when the carriage 3 is moved along the guide shaft 6 in an initial operation.

The above-described ink-jet printing apparatus controls a series of printing operations in such a manner that data such as image information and a control command entered from an external host device or the like is received by a printing controller (described later), the received data is expanded into image data of each color and then transferred to the printhead, the carriage 3 is caused to scan across the printing medium and ink is discharged at the required timing.

The printing controller and the carriage 3 are connected by a flexible cable 13 and receive various signals and power necessary for ink discharge.

An embodiment of the present invention applied to the ink-jet printing apparatus having the structure set forth above will now be described in detail.

Figure 1:
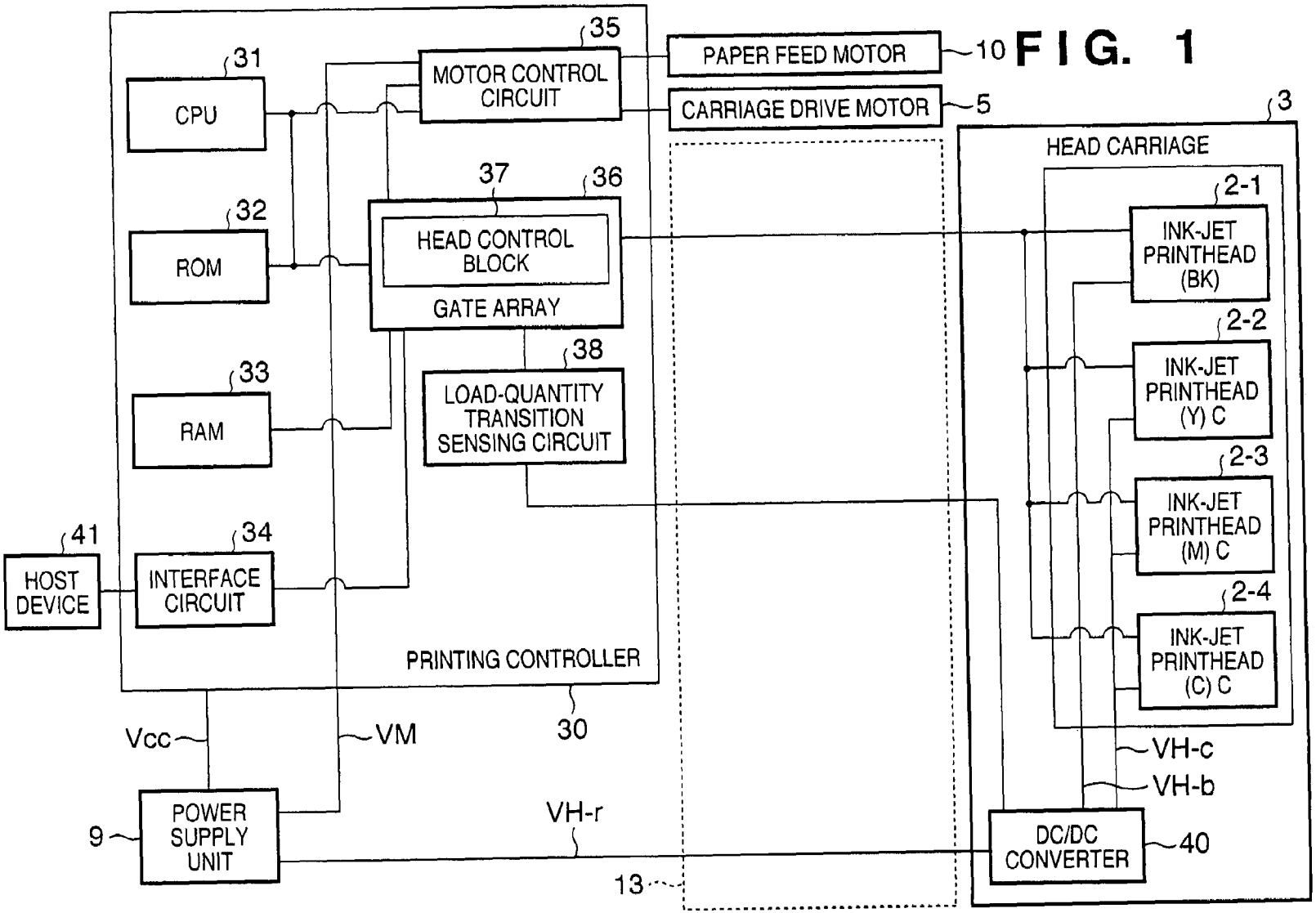
FIG. 1 is a block diagram illustrating the structure of an embodiment of the present invention.

FIG. 1 is a block diagram illustrating the structure of this embodiment of the present invention.

As shown in FIG. 1, a printing controller 30 includes a CPU 31; a ROM 32 and a RAM 33 serving as memories; an interface circuit 34 for interfacing a host device 41, which is an external device; a motor control circuit 35 for driving the carriage drive motor 5 and a paper feed motor 10; and a gate array 36 comprising a logic circuit for performing control to assist the operation of the CPU 31.

A head control block 37 for controlling the discharge timing of the ink-jet printhead 2 and for driving the printhead is incorporated in the gate array 36.

A stepping motor is used as the carriage drive motor 5. While sending the motor control circuit 35 a signal for the carriage drive motor 5 in order to move the carriage 3, the CPU 31 simultaneously manages the number of pulses from the reference position along the scanning direction to thereby ascertain the present location of the carriage 3.

When the carriage 3 is moved and the mounted printheads 2-1 to 2-4 arrive at locations where the ink is to be discharged, the head control block 37 exercises control so as to discharge ink.

According to this embodiment, the printing position along the scanning direction is thus detected by managing the drive pulses applied to the motor. A printing apparatus provided with a special-purpose encoder for detecting the carriage position is common.

The CPU 31 controls the overall operation of the ink-jet printing apparatus in accordance with a program already stored in the ROM 32 or a control command that has entered from the host device 41 via the interface circuit 34.

A program run by the CPU 31, various table data necessary for head control and character data for creating character data have been installed in the ROM 32.

The interface circuit 34 is an interface for when a control command is sent from the host device 41 to the ink-jet printing controller and for when control data is input and output.

The RAM 33 includes a work area for when the CPU 31 performs processing, etc., as well as a temporary storage area for print data and control codes that have entered from the host device 41 via the interface circuit 34. The RAM 33 also is constructed to have a print buffer for storing print data after it has been converted into bit data corresponding to the nozzles of the printhead.

A power supply unit 9 supplies the printing controller 30 with a Vcc voltage for driving the logic, supplies the motor control circuit 35, paper feed motor 10 and carriage drive motor 5 with a VM voltage for driving the motors, and supplies a DC/DC converter 40 with a VH-r for printhead drive via the flexible cable 13.

A load-quantity transition sensing circuit 38 senses the number of pixels conforming to the driven number of nozzles of the printhead from a serial data signal 37-13, which is part of the control signal sent to the head carriage 3 from the gate array 36 that includes the head control block 37, detects the state of transition of a certain specific number of pixels and transmits a control signal to a control-voltage correcting circuit 39 via the flexible cable 13, thereby varying and controlling head drive voltages VH-b and VH-c, which are output voltages of the DC/DC converter 40.

Figure 2:
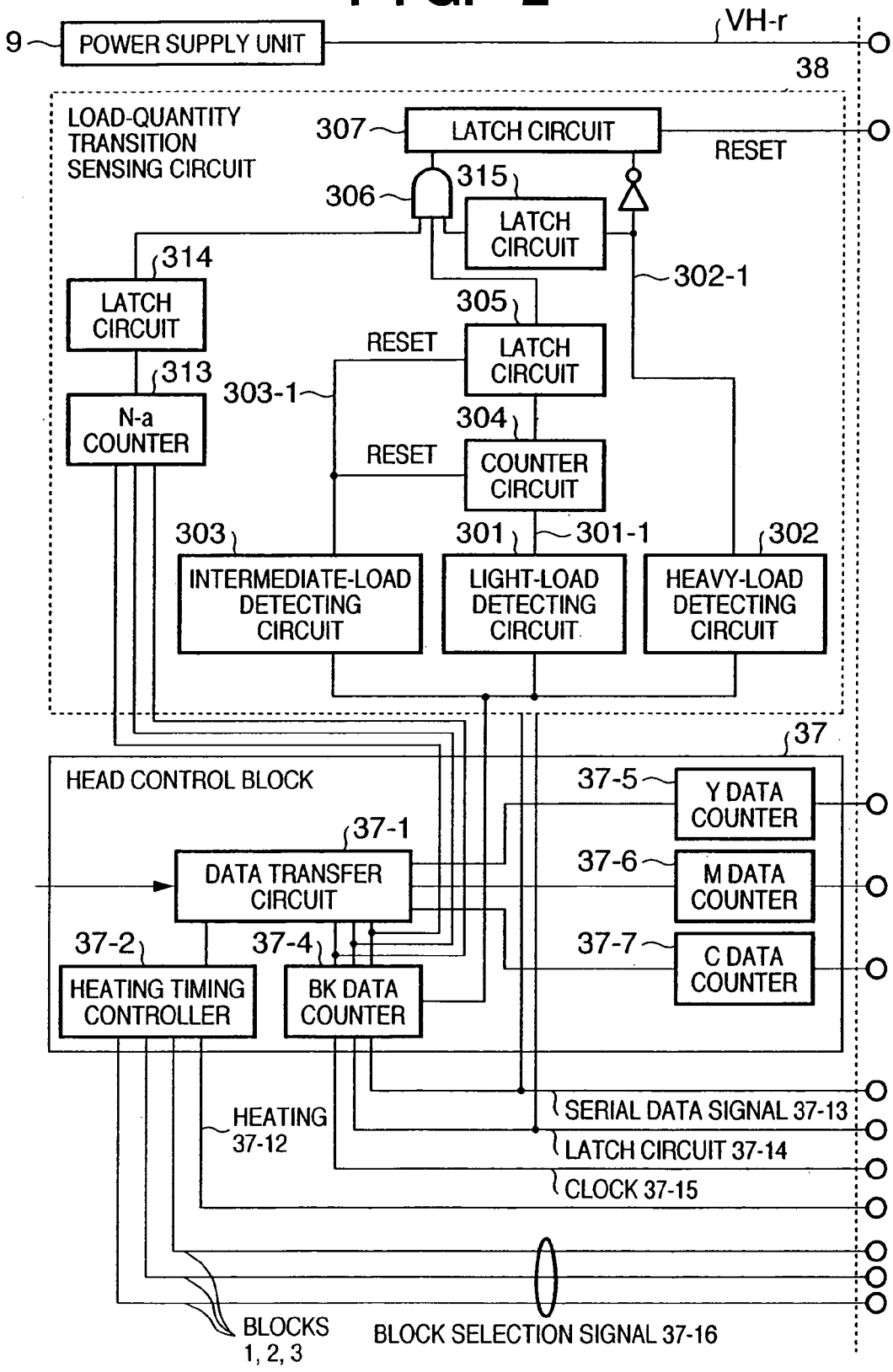
FIG. 2 is a circuit diagram illustrating the details of a head control block and load-quantity transition sensing circuit in FIG. 1.
Figure 3:
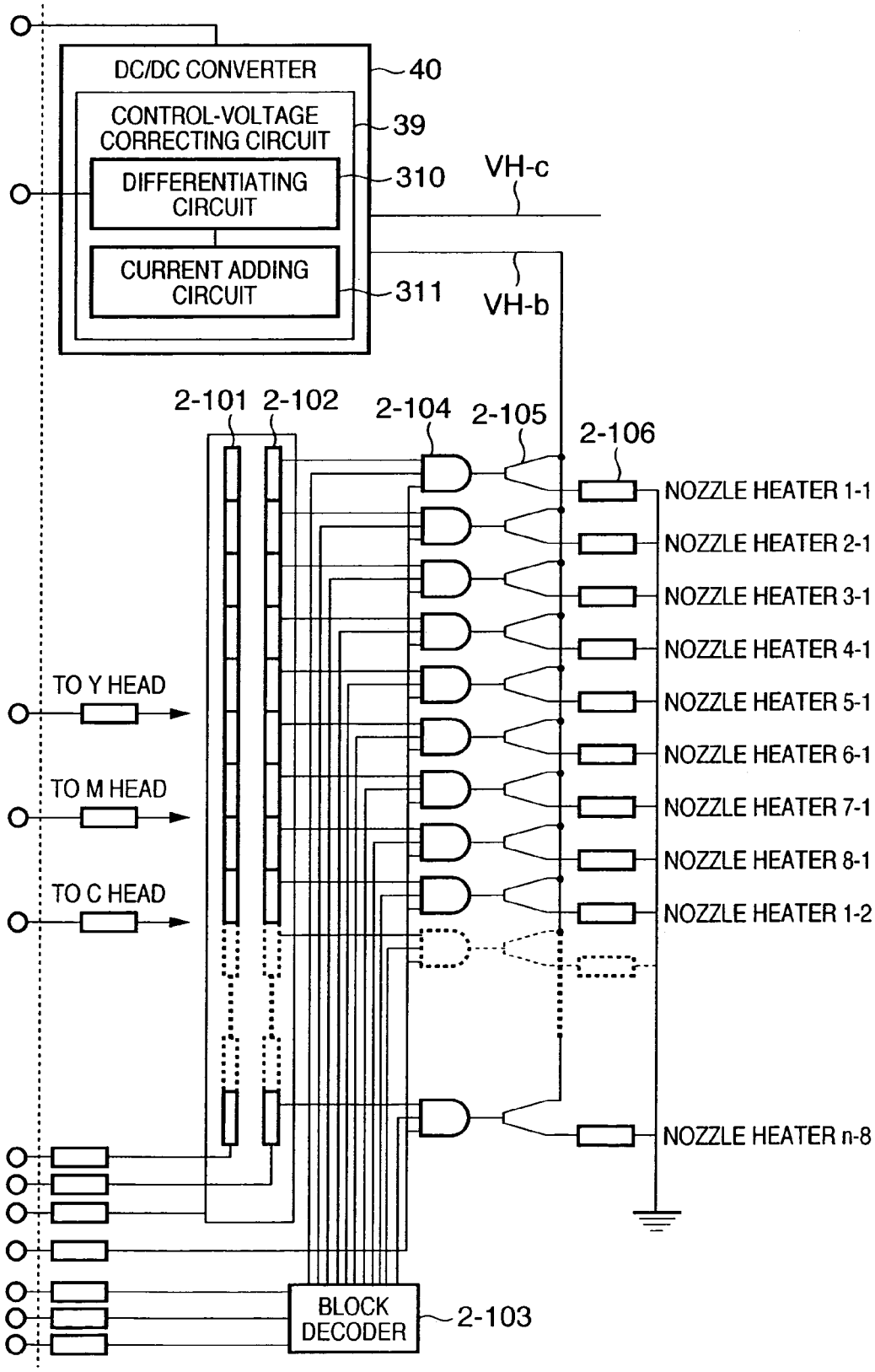
FIG. 3 is a circuit diagram illustrating the details of circuitry provided in a head carriage in FIG. 1.
Figure 9:
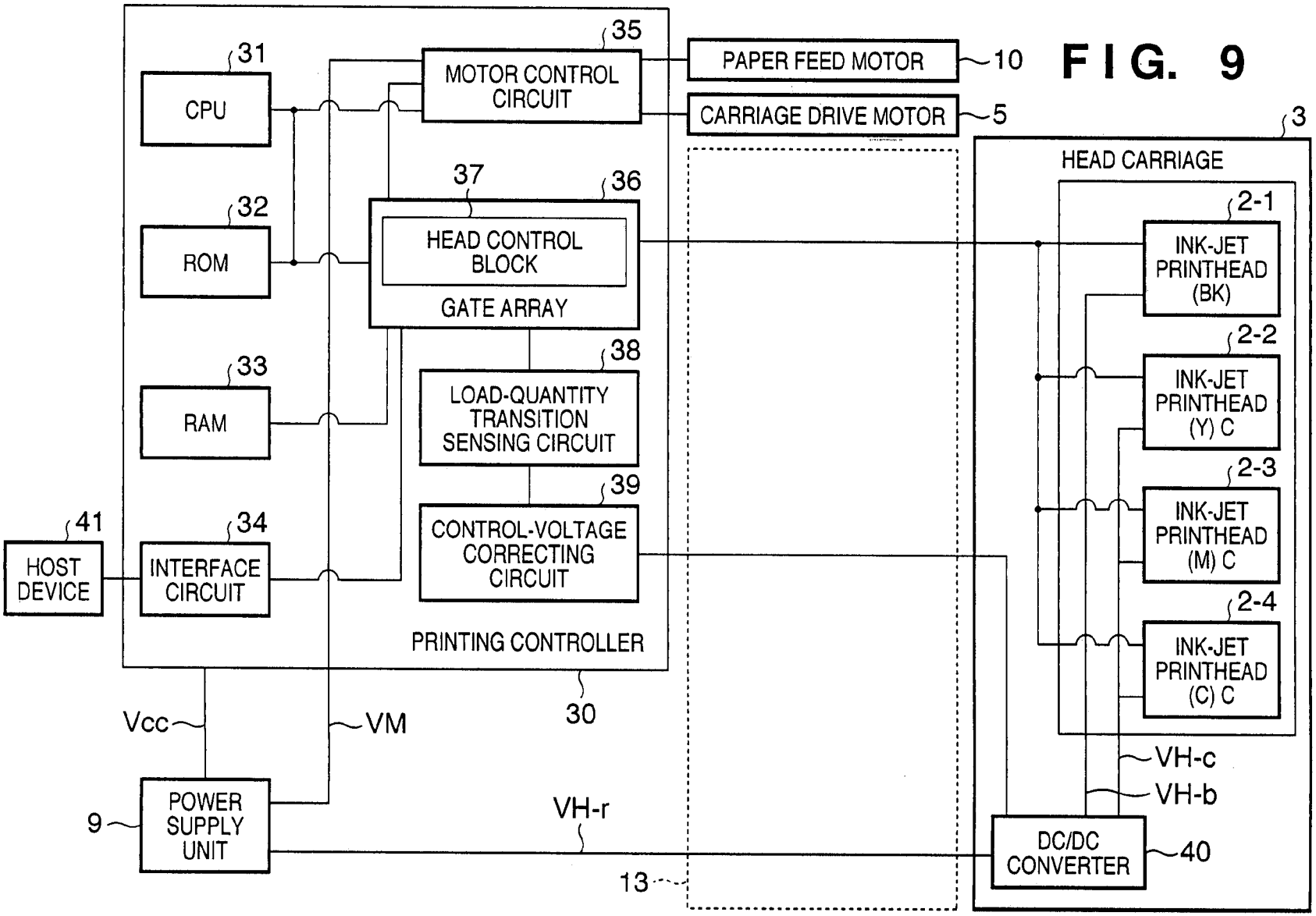
FIG. 9 is a block diagram illustrating the structure of a modification according to the present invention.

The ink discharge circuit and discharge control of the printhead in this embodiment will now be described in detail with reference to FIGS. 2 and 3, in which FIG. 2 is a circuit diagram illustrating the details of a head control block 37 and load-quantity transition sensing circuit 38 and FIG. 3 is a circuit diagram illustrating the details of circuitry provided in the head carriage 3. Though the control-voltage correcting circuit 39 in FIGS. 2 and 3 is provided in the DC/DC converter 40 of the head carriage 3 in FIGS. 2 and 3, in a modification it may just as well be provided in a printing controller on the side of the main unit, as illustrated in FIG. 9.

According to this embodiment, printing is carried out using four printheads. However, since the operating principle is the same for each printhead, a description will be rendered solely with regard to the Bk head 2-1.

The driving procedure for one cycle of printing operation of the printhead is as follows. A data transfer circuit 37-1 in the head control block 37 sends a serial data signal 37-13, a clock signal 37-15 and a latch signal 37-14 to the printhead in order to transmit discharge data. These signals are connected to the Bk head 2-1.

N-bits of serial data signal 37-13 are stored sequentially in a shift register 2-101, which has been constructed on the Bk head 2-1, in synchronism with the clock signal 37-15 and is used for the purpose of selecting which of the nozzles is to discharge ink. When transmission of data for this number of nozzles ends, the latch signal 37-14 is transmitted and the data that has been stored in the shift register 2-101 is shifted to a register 2-102, whereby the setting of the data ends.

When the setting of the data ends, three block selection signals 37-16 and a heating signal 37-12 are transmitted from a heating timing controller 37-2 in accordance with the position of the carriage 3. In this embodiment, nozzles of the same block are arranged at intervals of eight nozzles. A block that has been selected by the three block selection signals 37-16 activates the input signals to AND gates 2-104 of this block by a decoder 2-103 constructed on the Bk head 2-1.

When the heating signal 37-12 is input to nozzles for which data has been set and blocks selected through the above-described procedure, three inputs of the AND gates 2-104 all attain the high level, drive transistors 2-105 connected to corresponding nozzle heaters 2-106 operate and current flows into the nozzle heaters. The heating signal 37-12 is used for the purpose of controlling the actual conduction time in order to control temperature, etc.

Ink droplets are discharged toward the prescribed position by continuing the above-described one cycle operation, whereby a series of printing operations is achieved.

A BK data counter 37-4 counts the number of nozzles actually driven based upon the serial data signal 37-13, and the output of the counter is connected to a light-load detecting circuit 301, a heavy-load detecting circuit 302 and an intermediate-load detecting circuit 303.

The load-quantity transition sensing circuit 38 includes an N-a counter 313 for detecting the timing of a higher-order (N-a)th bit of the serial data 37-13 transmitted N bits at a time in synchronism with the latch signal and sending a signal indicative of this timing to a latch circuit 314. For example, if N is 1024 and a is 256, the transfer timing is detected by using 768th bit data. The latter maintains a high-level signal until it is reset by the latch signal 37-15 of the next serial data signal, and transmits the high-level signal to an AND gate 306 from the (N-a)th bit to an Nth bit.

The light-load detecting circuit 301, heavy-load detecting circuit 302 and intermediate-load detecting circuit 303 each detect the number of nozzles driven simultaneously from the higher-order N-a bits (which are transferred first in N bits) of the serial data 37-13 transmitted N bits at a time, and output a detection signal when the detected number of nozzles falls within a detection range set beforehand for each circuit.

The detection ranges of respective ones of the light-load detecting circuit 301, heavy-load detecting circuit 302 and intermediate-load detecting circuit 303 are set beforehand based upon the total number of nozzles of the printhead, the number of bits of serial data signal N-a to be detected, and the step response capability of the feedback control circuit of the DC/DC converter 40. The ratio (driving duty) of the number of driven nozzles to the total number of nozzles of the printhead is classified into three stages, namely stages of light, heavy and intermediate loads, and signals are output to the DC/DC converter 40 in accordance with the classification to thereby change the amount of current supplied to the printhead.

The classifications of the driving duty are not limited to the three stages of this embodiment, and an arrangement may be adopted in which the duty is classified more finely into a number of stages.

The light-load detecting circuit 301 outputs a detection signal 301-1 to a counter circuit 304 if nozzle discharge information is not contained in data of the higher-order N-a bits of the serial data 37-13 from the signal of BK data counter 37-4, or if the nozzle discharge information is extremely small. The detection signal 301-1 is counted by the counter circuit 304. When the value of the count is greater than a predetermined number, i.e., when the light-load state continues for more than a set period of time, a high-level signal is output from a latch circuit 305 to the AND gate 306.

It should be noted that the light-load detecting circuit 301 does not output the detection signal 301-1 in a case where the number of nozzles driven simultaneously included in the data of the higher-order N-a bits of the serial data signal 37-13 from the signal of the BK data counter 37-4 is greater than a set value.

The intermediate-load detecting circuit 303 outputs a detection signal 303-1 in a case where the number of nozzles driven simultaneously included in the data of the higher-order N-a bits of the serial data signal 37-13 from the signal of the BK data counter 37-4 is outside a range detected by the light-load detecting circuit 301 and the heavy-load detecting circuit 302. If the intermediate-load detecting circuit 303 outputs the detection signal, a reset signal is output to reset terminals of the counter circuit 304, which is connected to the light-load detecting circuit 301, and of the latch circuit 305, whereby the counter circuit 304 and the latch circuit 305 are reset.

It should be noted that the intermediate-load detecting circuit 303 does not output the detection signal 303-1 when the number of nozzles driven simultaneously included in the data of the higher-order N-a bits of the serial data signal 37-13 is outside the set range.

The heavy-load detecting circuit 302 outputs a detection signal 302-1 in a case where the number of nozzles driven simultaneously included in the data of the higher-order N-a bits of the serial data signal 37-13 from the signal of the BK data counter 37-4 is greater than a predetermined number (e.g., a case where the number of nozzles driven simultaneously is greater than 80% of the total number of nozzles).

It should be noted that the heavy-load detecting circuit 302 does not output the detection signal 302-1 in a case where the number of nozzles driven simultaneously included in the data of the higher-order N-a bits of the serial data signal 37-13 is less than a set value.

The AND gate 306 has three input terminals. The output of the latch circuit 305 is input to one of these input terminals so that the AND gate 306 assumes the high level when the light-load state continues for more than the set period of time. The output of the heavy-load detecting circuit 302 is connected to one other input terminal of the AND gate 306 via a latch circuit 315, and the output of the N-a counter 313 is connected to the remaining input terminal of the AND gate 306 via the latch circuit 314.

If there is a transition from the light-load state to the heavy-load state, the timing of the higher-order (N-a)th bit of the N-bit serial data signal 37-13 is detected and a high-level signal is output from the latch circuit 314, all three inputs to the AND gate 306 assume the high level and a high-level signal is output from the AND gate 306. The high-level signal output from the AND gate 306 passes through a latch circuit 307 and enters the control-voltage correcting circuit 39 of the DC/DC converter 40 at a timing that is earlier, by the time needed to send a-number of bits, than that at which the serial data signal 37-13 is actually set in the shift register 2-101.

That is, a transition from the light-load state, in which the number of nozzles driven simultaneously is very small, to the heavy-load state, which is one near full discharge of ink from all nozzles, is detected. Then the control circuit of the DC/DC converter is so notified at a timing that is earlier, by the time needed to send a-number of bits, than that at which drive is actually performed under a heavy load.

The output of the latch circuit 307 of the load-quantity transition sensing circuit 38 is input to a differentiating circuit 310 of the control-voltage correcting circuit 39 in the DC/DC converter, and the logic signal transmitted from the latch circuit 307 to the control-voltage correcting circuit 39 is converted by the differentiating circuit 310 to a differentiated waveform in which the edge portion of the logic signal is extracted.

Figure 4:
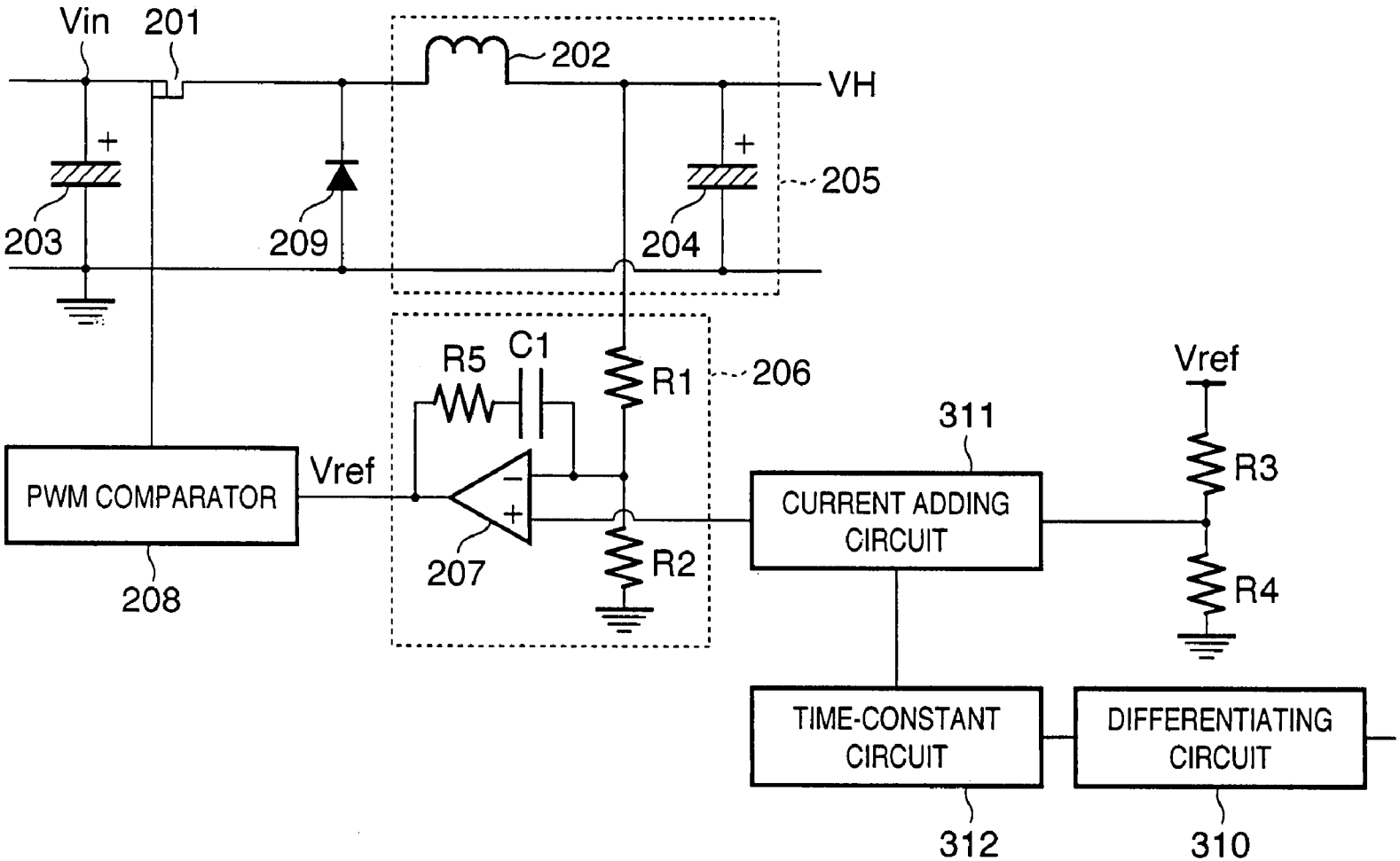
FIG. 4 is a diagram illustrating the details of a DC/DC converter in FIG. 3.

The structure and operation of the DC/DC converter 40 will be described next with reference to FIGS. 4 and 5. FIG. 4 illustrates the details of the DC/DC converter of this embodiment, and FIGS. 5A to 5E are time charts illustrating the states of signals in the DC/DC converter.

As shown in FIG. 4, the output of the load-quantity transition sensing circuit 38 is input to the differentiating circuit 310 of the control-voltage correcting circuit 39 in the DC/DC converter 40, and the output of the differentiating circuit 310 is input to a time-constant circuit 312. The output of the time-constant circuit 312 is input to a current adding circuit 311.

A pulsed logic signal output from the load-quantity transition sensing circuit 38 therefore is converted from the pulsed waveform to a differentiated waveform by the differentiating circuit 310. This differentiated waveform signal has its waveform blunted by the time-constant circuit 312 and then is input to the current adding circuit 311. The output of the current adding circuit 311 is applied to the non-inverting input terminal of the error amplifier 207 using, as a reference, a potential obtained by voltage-dividing the reference voltage Vref by the resistors R3 and R4.

Figure 5A:
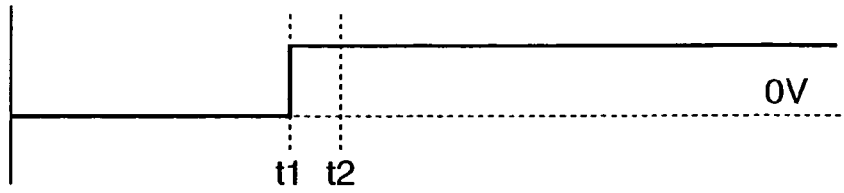
FIGS. 5A to 5E are time charts illustrating the states of signals at various points in the DC/DC converter.
Figure 5B:
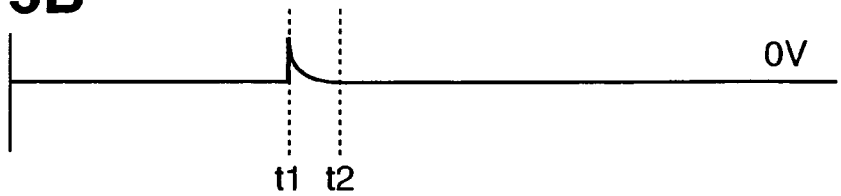
Figure 5C:
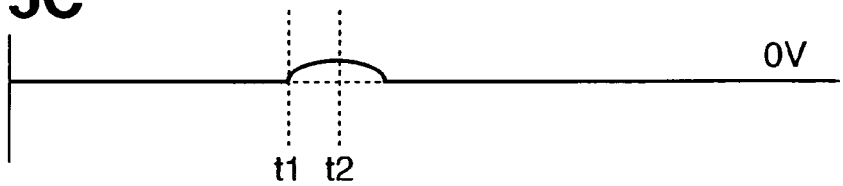
Figure 5D:
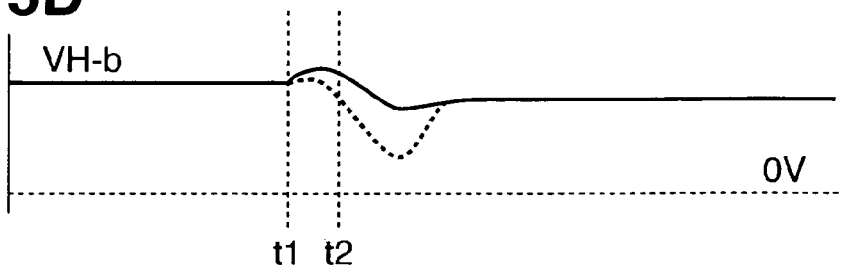
Figure 5E:
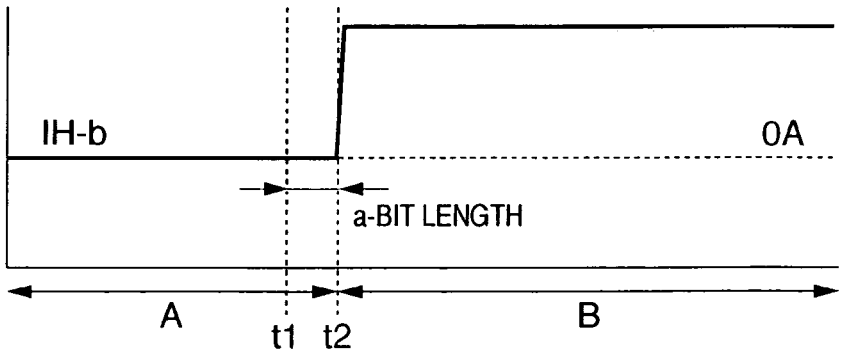

FIG. 5A indicates the state of the output signal from the load-quantity transition sensing circuit 38, FIG. 5B indicates the state of the output signal from the differentiating circuit 310, FIG. 5C indicates the state of the output signal from the time-constant circuit 312, FIG. 5D indicates the output voltage waveform from the DC/DC converter 40 and FIG. 5E indicates the current waveform supplied by the DC/DC converter 40.

Along the horizontal axis representing time in FIGS. 5A to 5E, t1 denotes the timing at which the load-quantity transition sensing circuit 38 senses the transition from the light-load state to the heavy-load state, and t2 denotes the timing at which the heavy-load state is actually attained. Accordingly, the interval indicated by A is the light-load state and that indicated by B is the heavy-load state.

Further, the waveform indicated by the dashed line at (d) represents the output waveform from the DC/DC converter 40 in a case where the load-quantity transition sensing circuit 38 and control-voltage correcting circuit 39 of this embodiment are absent.

The error amplifier 207 adjusts the ON/OFF timing of the switching element 201 so as to equalize the voltage values of the inverted and non-inverted inputs. Accordingly, the error amplifier 207 attempts to control the output voltage VH-b in the increasing direction by an amount equivalent to the potential obtained by superimposing the waveform obtained by blunting the differentiated waveform using the differentiating circuit 310 and time-constant circuit 312 onto the potential obtained by differentiating the reference voltage Vref by the resistors R3 and R4. This control for raising the value of VH-b starts at a timing that is earlier, by the time needed to send a-number of bits, than that at which nozzles are driven by the serial data signal 37-13 sent to the register 2-101 within the printhead.

The reason for this is that the light-load detecting circuit 301, heavy-load detecting circuit 302 and intermediate-load detecting circuit 303 within the load-quantity transition sensing circuit 38 adopt only the higher-order N-a bits of the N-bit serial data signal 37-13 as the object of processing, and the N-a counter 313 extracts the timing of the (N-a)th bit.

Thus, control for raising the output voltage is carried out at a timing that is earlier, by the time needed to send a-number of bits, than the timing at which all of the serial data signal 37-13 is stored in the register 2-101 and actual drive is performed, and control for increasing the gain K of the feedback control circuit is carried out before a sudden load fluctuation actually takes place.

Figure 6:
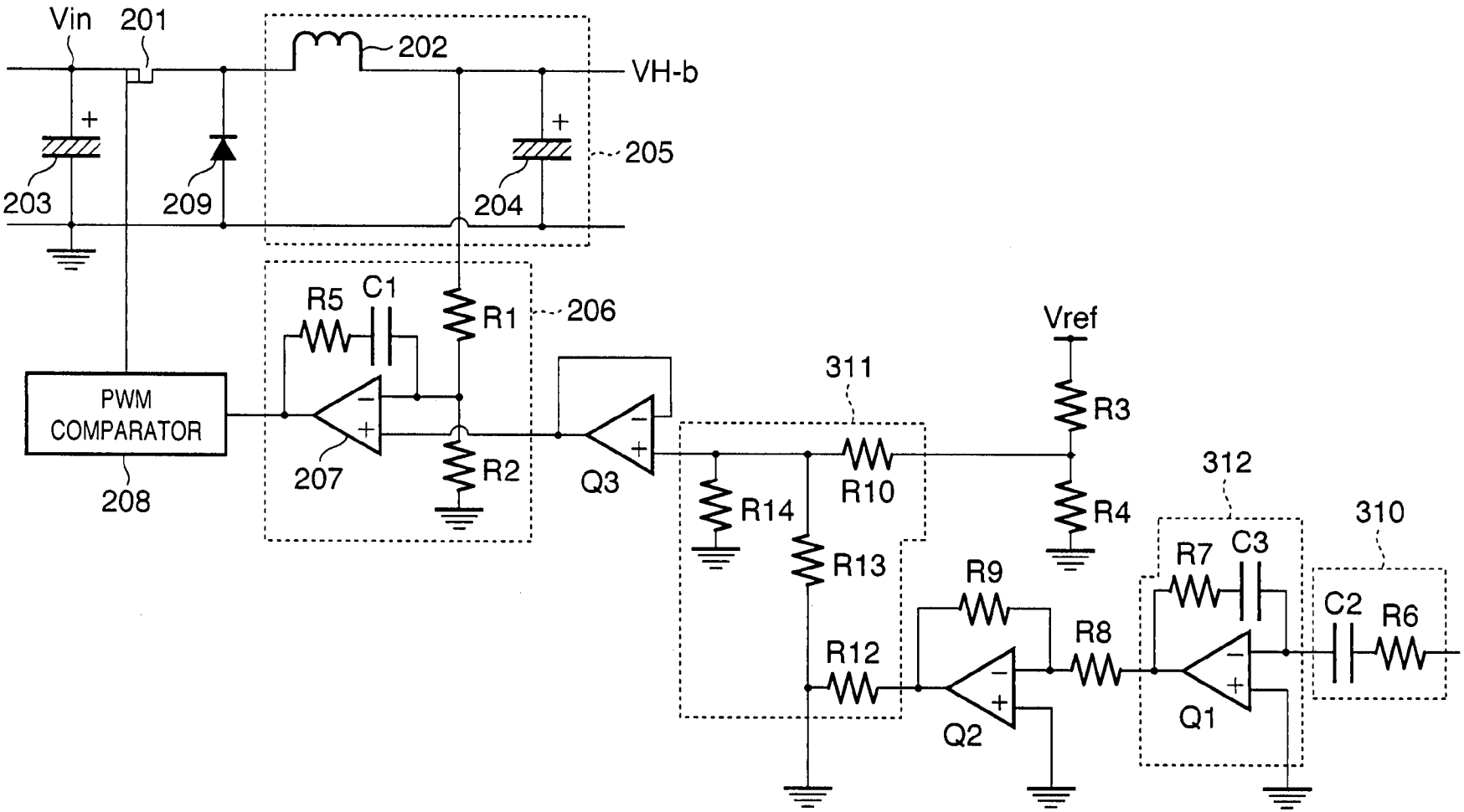
FIG. 6 is a diagram illustrating an example of the structure of a control-voltage correcting circuit.
Figure 7:
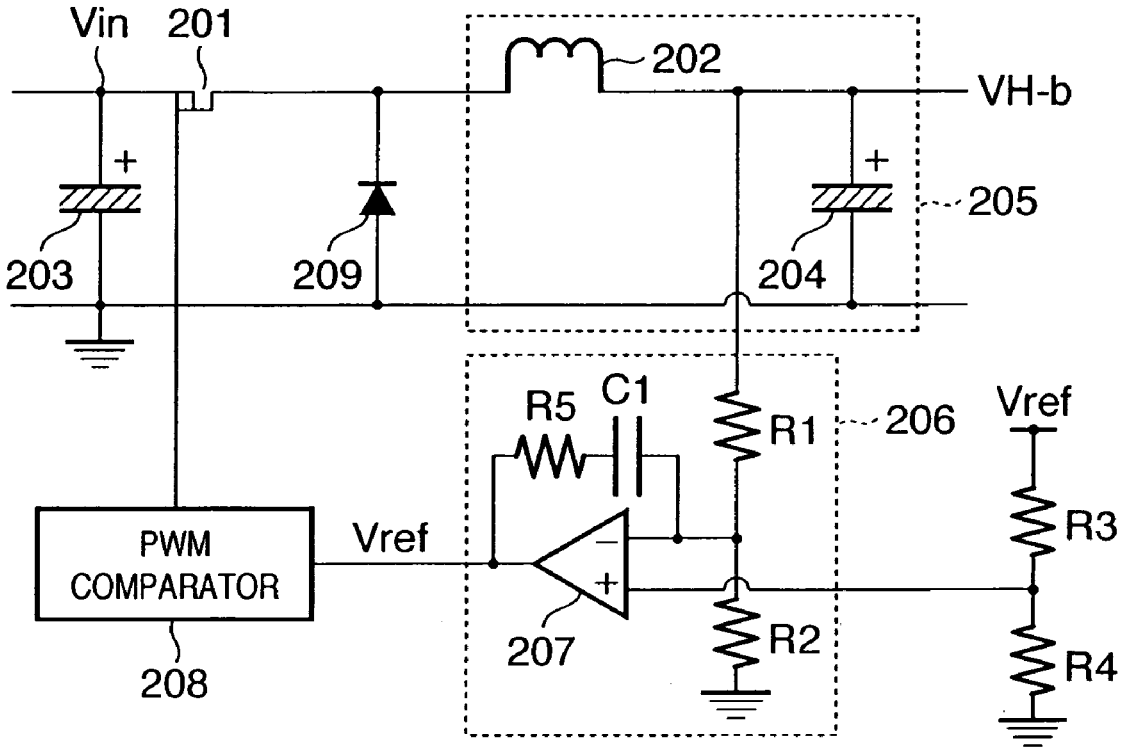
FIG. 7 is a circuit diagram illustrating an example of the structure of a conventional DC/DC circuit and its voltage control circuit.

An example of the structure of the control-voltage correcting circuit 39 of this embodiment will now be described with reference to FIG. 6.

The differentiating circuit 310 comprises a capacitor C2 and a resistor R6 that are provided as an input stage. In the example depicted in FIG. 6, a two-stage amplifier structure composed of inverting amplifiers Q1 and Q2 is adopted and gain is adjusted by the values of resistors R6, R7, R8, R9. The time-constant circuit 312 comprises a resistor R7, which is inserted between the inverting input terminal and the output terminal of the amplifier Q1, and a capacitor C3 connected in series with the resistor R7. As a result, a signal that is the result of adding the waveform obtained by blunting the differentiated waveform by the resistor R7 and capacitor C3 to the potential obtained by differentiating the reference voltage Vref by the resistors R3 and R4 is input to the non-inverting input terminal of the error amplifier 207 by a ladder-type D/A converter comprising resistors R10, R12, R13 and R14.

Thus, as described above, the maximum value of the differentiated waveform blunted by the time-constant circuit 312 can be made to conform to the timing at which the nozzles of the printhead are actually driven or to the timing at which the drop in output voltage takes on a maximum value owing to the actual delay in feedback control of the DC/DC converter 40, and it is possible to correct the amount of the voltage drop in an interval in which the response of feedback control of DC/DC converter 40 cannot follow up, this accompanying a sudden load fluctuation from the light-load state in which few nozzles are driven to the heavy-load state in which all nozzles are driven.

It should be noted that although voltage rises immediately before the nozzles of the printhead are driven, as indicated in the timechart of FIG. 5D, no problems will arise so long as the upper-limit value of output voltage in terms of the specifications of the DC/DC converter is not exceeded.

Further, though not set forth in this embodiment, a paper-feed motor signal or a drive motor signal may be adopted separately as an input to the light-load detecting circuit as a signal for detecting, from paper feed or an initial operation, that the printhead is in a non-driven state.

In this embodiment, the output voltage of the DC/DC converter is supplied equally to four printheads. However, even in a multiple-output configuration that supplies two outputs for obtaining different output voltages with respect to the Bk printhead and color printhead or different output voltages to the printheads of each of the colors, similar effects are obtained by providing each output voltage or each output voltage control circuit with the load-quantity transition sensing circuit 38 and control-voltage correcting circuit 39.

Further, though this embodiment adopts a two-output DC/DC converter in which the BK printhead 2-1 and Y, M, C color printheads have separate power supplies, it is possible to calculate values obtained by counting the serial data signals of each of the colors and adopt the same output voltage, or it may be so arranged that the serial data is counted printhead by printhead and a different output voltage is produced for each color.

In the description rendered above, the time from detection of the higher-order (N-a)th bit of the serial data signal 37-13 to storage of the serial data signal 37-13 in the shift register

2-101 is assumed to be equal to the time needed to transmit a-number of bits. However, it is necessary to also take into consideration the time at which the latch signal and heating signal 37-12 at the time of transfer to the register 2-104 are output by the time the nozzles of the printhead are actually driven. However, no problems arise in practicing this embodiment so long as time is assured from the moment at which the transition from the light-load state to the heavy-load state is detected by the load-quantity transition sensing circuit to the moment the printhead is actually driven.

OTHER EMBODIMENTS

The foregoing embodiment has been described taking as an example an ink-jet printing apparatus equipped with a printhead having a plurality of nozzles serving as printing elements and heaters provided for respective ones of the nozzles, with power being supplied to the heaters to achieve drive. However, the present invention is applicable also to a printing apparatus having another type of printhead.

Further, the printing apparatus of the foregoing embodiment is a serial-type printing apparatus that performs printing by causing a printhead to scan across a printing medium. However, the present invention is applicable to a printing apparatus, even of another type, that performs printing by a printhead equipped with a plurality of printing elements each driven by electrical energy, wherein the number of printing elements driven at the same time is changed in accordance with print data.

In other words, the present invention can be applied broadly to control of a printhead having a plurality of printing elements each of which is driven by electrical energy.

The present invention can be applied to a system comprising a plurality of devices (e.g., host computer, interface, reader, printer) or to an apparatus comprising a single device (e.g., copying machine, facsimile machine).

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code itself installed in the computer also implements the present invention. In other words, the claims of the present invention also cover a computer program for the purpose of implementing the functions of the present invention.

In this case, so long as the system or apparatus has the functions of the program, the program may be executed in any form, e.g., as object code, a program executed by an interpreter, or scrip data supplied to an operating system.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

Further, it is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Furthermore, besides the case where the aforesaid functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing using a printhead having a plurality of printing elements, comprising:

means for inputting print data;

converting means for converting print data to drive data corresponding to the printing elements;

transfer means for transferring the drive data to the printhead in a serial format in units of N bits at a time;

driving means for driving the printing elements based upon the drive data;

counting means for counting M-bits of data transferred first among the drive data in synchronism with transfer of the drive data by said transfer means, where N>M;

detecting means for detecting an increase in the value of a count obtained by said counting means; and voltage generating means for outputting a voltage that drives the printing elements;

wherein if said detecting means has detected an increase in the value of the count, said voltage generating means raises the output voltage before said driving means performs drive based upon drive data transferred next, wherein said voltage generating means comprises an error amplifier for outputting a control signal in accordance with an error between a reference voltage and an input voltage, and if said detecting means has detected an increase in the value of the count, the value of the reference voltage is changed, and wherein said voltage generating means differentiates a signal that is output in accordance with detection by said detection means and adds a voltage, which has been obtained via a time-constant circuit and a current adding circuit, to the reference voltage.

2. A printing apparatus for performing printing using a printhead having a plurality of printing elements, comprising:

means for inputting print data;

converting means for converting print data to drive data corresponding to the printing elements;

transfer means for transferring the drive data to the printhead a prescribed number of bits at a time;

driving means for driving the printing elements based upon the drive data;

first detecting means for detecting an amount of power load of printing elements driven simultaneously, based upon the drive data transferred by said transfer means;

second detecting means for detecting an increase in the amount of power load; and voltage generating means for outputting a voltage that drives the printing elements;

wherein if said second detecting means has detected an increase in the amount of power load, said voltage generating means raises the output voltage before said driving means performs drive based upon drive data transferred next, wherein said voltage generating means comprises an error amplifier for outputting a control signal in accordance with an error between a reference voltage and an input voltage, and if said second detecting means has detected an increase in the amount of power load, the value of the reference voltage is changed, and wherein said voltage generating means differentiates a signal that is output in accordance with detection by said second detecting means and adds a voltage, which has been obtained via a time-constant circuit and a current adding circuit, to the reference voltage.

3. A method of controlling a printing apparatus for performing printing by a printhead having a plurality of printing elements each driven by electrical energy, the number of printing elements driven simultaneously being changed in accordance with drive data, said method comprising:

a transfer step of transferring drive data to the printhead in a serial format in units of N bits at a time;

a counting step of counting M-bits of data transferred first among the transferred drive data, where N>M;

a determination step of determining whether the number of simultaneously driven printing elements has increased greatly, based upon a count value regarding print data that has been transferred previously and a count value regarding drive data to be transferred later;

a generation step of generating a determination signal indicating the determination result and generating a voltage signal; and an energy increasing step of increasing electrical energy by adding to a reference voltage of a DC/DC converter, which is supplied to the printhead, before the printhead is driven by drive data to be transferred later, if it has been determined that the number of simultaneously driven printing elements has increased greatly, wherein the voltage signal is generated by a differential circuit and a time-constant circuit in the DC/DC converter.

* * * * *